US006289963B1

(12) United States Patent
Vaske

(10) Patent No.: US 6,289,963 B1
(45) Date of Patent: Sep. 18, 2001

(54) DUAL CLOSURE SYSTEM FOR OVERHEAD DOORS

(76) Inventor: Kent J. Vaske, 206 E. Harrison St., Bancroft, IA (US) 50517

( * ) Notice: Subject to any disclaimer, the term of this patent is extended or adjusted under 35 U.S.C. 154(b) by 0 days.

(21) Appl. No.: 09/595,685

(22) Filed: Jun. 16, 2000

(51) Int. Cl.[7] ..... E06B 3/32
(52) U.S. Cl. ..... 160/89; 160/113; 160/188
(58) Field of Search ..... 160/113, 89, 90, 160/114, 201, 188

(56) References Cited

U.S. PATENT DOCUMENTS

| | | | | |
|---|---|---|---|---|
| 2,072,092 | * | 3/1937 | Blodgett | 160/113 |
| 2,570,199 | * | 10/1951 | Brown | 160/113 |
| 3,021,896 | * | 2/1962 | Buono et al. | 160/113 |
| 3,103,967 | * | 9/1963 | Gashen | 160/113 |
| 5,050,660 | * | 9/1991 | Bleichwehl et al. | 160/113 |
| 5,408,789 | * | 4/1995 | Plfeger | 160/113 |

* cited by examiner

*Primary Examiner*—Blair M. Johnson
(74) *Attorney, Agent, or Firm*—Zarley, McKee, Thomte, Voorhees & Sease

(57) ABSTRACT

A dual closure system for overhead doors in a structure having a floor, a vertical wall, a ceiling structure, and a rectangular door opening in the wall which extends from the floor upwardly in a direction towards the ceiling has a pair of spaced tracks with a vertical segment extending upwardly from the floor adjacent vertical sides of the door opening, and terminating through curved track segments into a pair of vertically horizontal upper and lower track portions. The curved track segments both have lower ends arcuately merging into alignment with an upper end of the vertical segments of tracks. The upper ends of the curved track segments terminate in vertically spaced horizontal track portions. First and second foldable doors which have sets of rollers on their side edges are movably mounted one each in the horizontal portions of the track so that each door can be individually moved into a vertical position in the vertical segment of the tracks.

12 Claims, 4 Drawing Sheets

10
12
14
16
18
20
22
24
26
28
30
32
34
36
38
38A
40
40A
42
44
46
48
50
52
54
55
56
58
60
62
64
66
68

10
12
14
16
18
20
22
24
26
28
30
32
34
36
38
38A
40
40A
42
44
46
48
50
52
54
56
58
60
62

10
12
46
48
50
52
54
56
58
60
62
64
66
68
70
72
74
38
40
44
38A
40A

DUAL CLOSURE SYSTEM FOR OVERHEAD DOORS

BACKGROUND OF THE INVENTION

There are many different garage screen door systems on the market today, but they have many shortcomings. These screen systems serve the purpose of screening the typical garage door opening while the conventional garage door is in an open position, thus protecting the interior of the garage from insects, and debris which might otherwise be blown into the garage.

Existing garage door screen systems often have to be manually installed during the spring season. Others do not function well in conjunction with the existing solid garage door which also must be opened and closed even during warm seasons for security and other reasons. Other garage door screen systems involve using zippers, adhesive strips, and a plurality of cranks to be operated.

It is therefore a principal object of this invention to have a dual closure system for overhead doors including independently operated foldable screen doors used in conjunction with conventional hinged garage doors comprised of a plurality of panels.

A further object of this invention is to provide a dual closure system for overhead doors which is easy to install, easy to operate, and is economical in construction.

These and other objects will be apparent to those skilled in the art.

SUMMARY OF THE INVENTION

A dual closure system for overhead doors in a structure having a floor, a vertical wall, a ceiling structure, and a rectangular door opening in the wall which extends from the floor upwardly in a direction towards the ceiling has a pair of spaced tracks with a vertical segment extending upwardly from the floor adjacent vertical sides of the door opening, and terminating through curved track segments into a pair of vertically horizontal upper and lower track portions. The curved track segments both have lower ends arcuately merging into alignment with an upper end of the vertical segments of tracks. The upper ends of the curved track segments terminate in vertically spaced horizontal track portions.

First and second foldable doors which have sets of rollers on their side edges are movably mounted one each in the horizontal portions of the track so that each door can be individually moved into a vertical position in the vertical segment of the tracks.

DESCRIPTION OF THE PREFERRED EMBODIMENT

Figure 2:
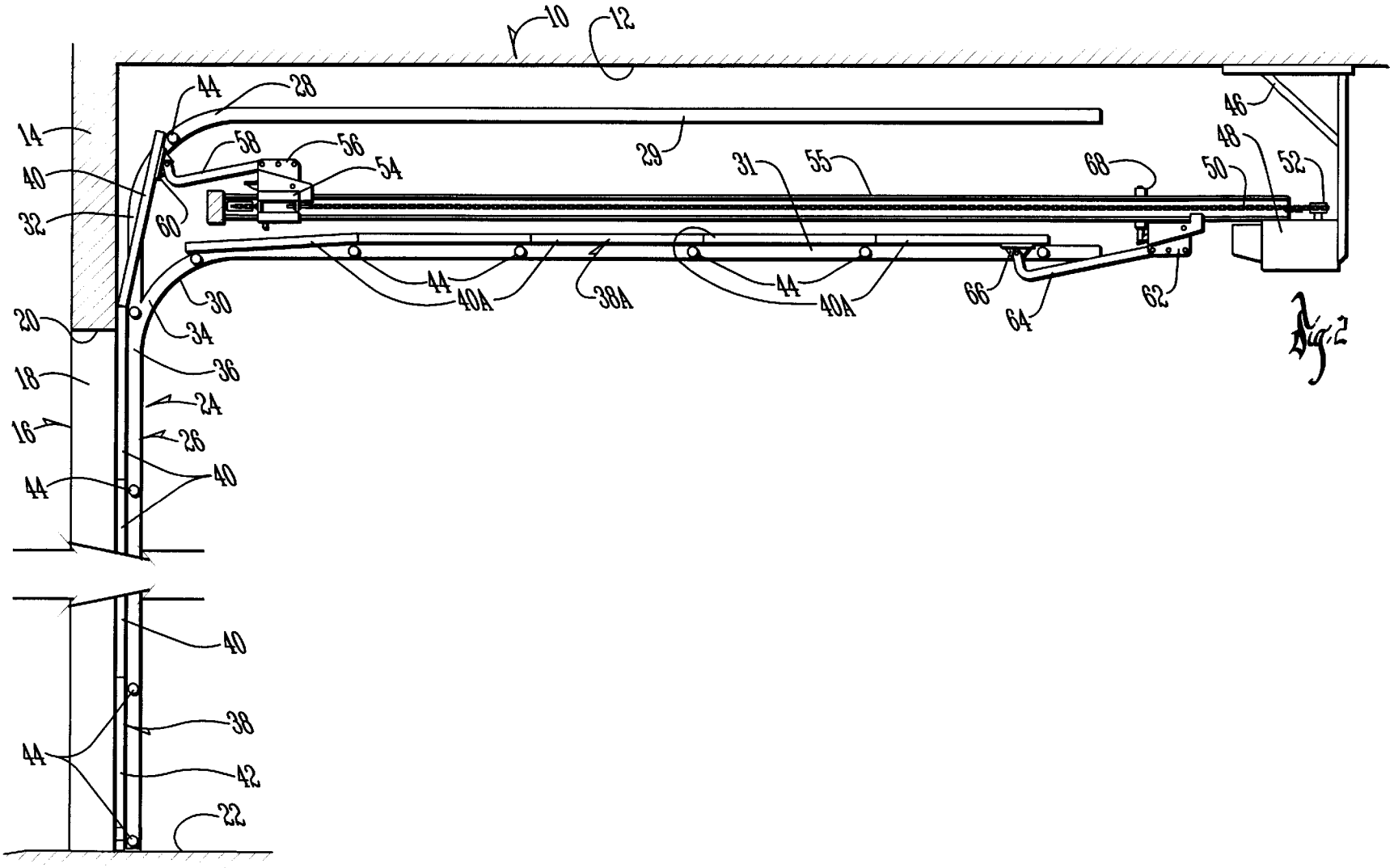
FIG. 2 is a partial sectional view of a garage showing a side elevational view of the dual closure system, with the solid door being in a closed position and the screen door being an open position.
Figure 3:
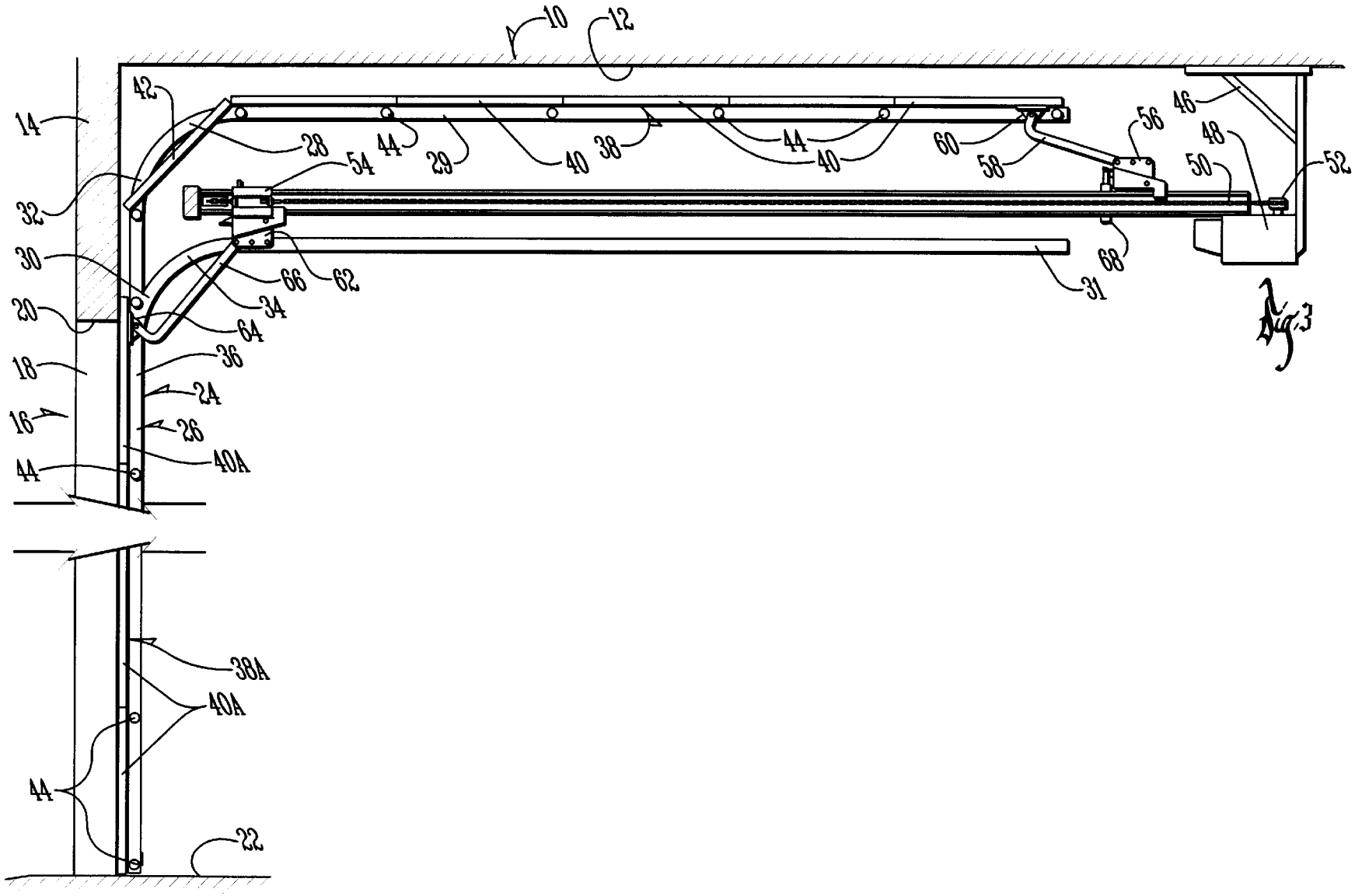
FIG. 3 is a view similar to that of FIG. 2 but shows both the solid door and the screen door in an open position.

A garage structure 10, as best shown in FIGS. 2 and 3, has a roof or ceiling 12, a vertical wall 14 with a door opening 16 located therein. The door opening 16 has sides 18, a top 20 and a bottom comprised of floor 22.

A pair of tracks 24 having a conventional U-shaped configuration are secured by any convenient means to the sides 18 of door opening 16. The tracks 24 each include vertical track segments 26 (FIGS. 2 and 3). A curved track segment 28 on each vertical track segment 26 arcuately merges into a horizontal track portion 29. In addition, a second curved track segment 30 located below curved track segment 28 arcuately merges into a second horizontal track portion 31 which is parallel to horizontal track portion 29. The curved track segments 28 have lower ends 28 and the curved track segments 30 have lower ends 34. The vertical track segments 26 have upper ends 26. (FIGS. 2 and 3).

A first foldable door 38 is comprised of a plurality of horizontal panels 40 which are conventionally hinged together to pivot about a horizontal axis. The panels 40 are of solid construction as are most conventional overhead garage doors. Door 38 has a bottom panel 42 which dwells substantially within the curved track segment 28 (FIG. 3) when the door 38 is in its open condition. Door 38 has a plurality of conventional rollers 44 which permit the door 38 to move from horizontal track portion 29 into the vertical track segments 26 as it moves from an open to a closed position, and vice versa.

Figure 1:
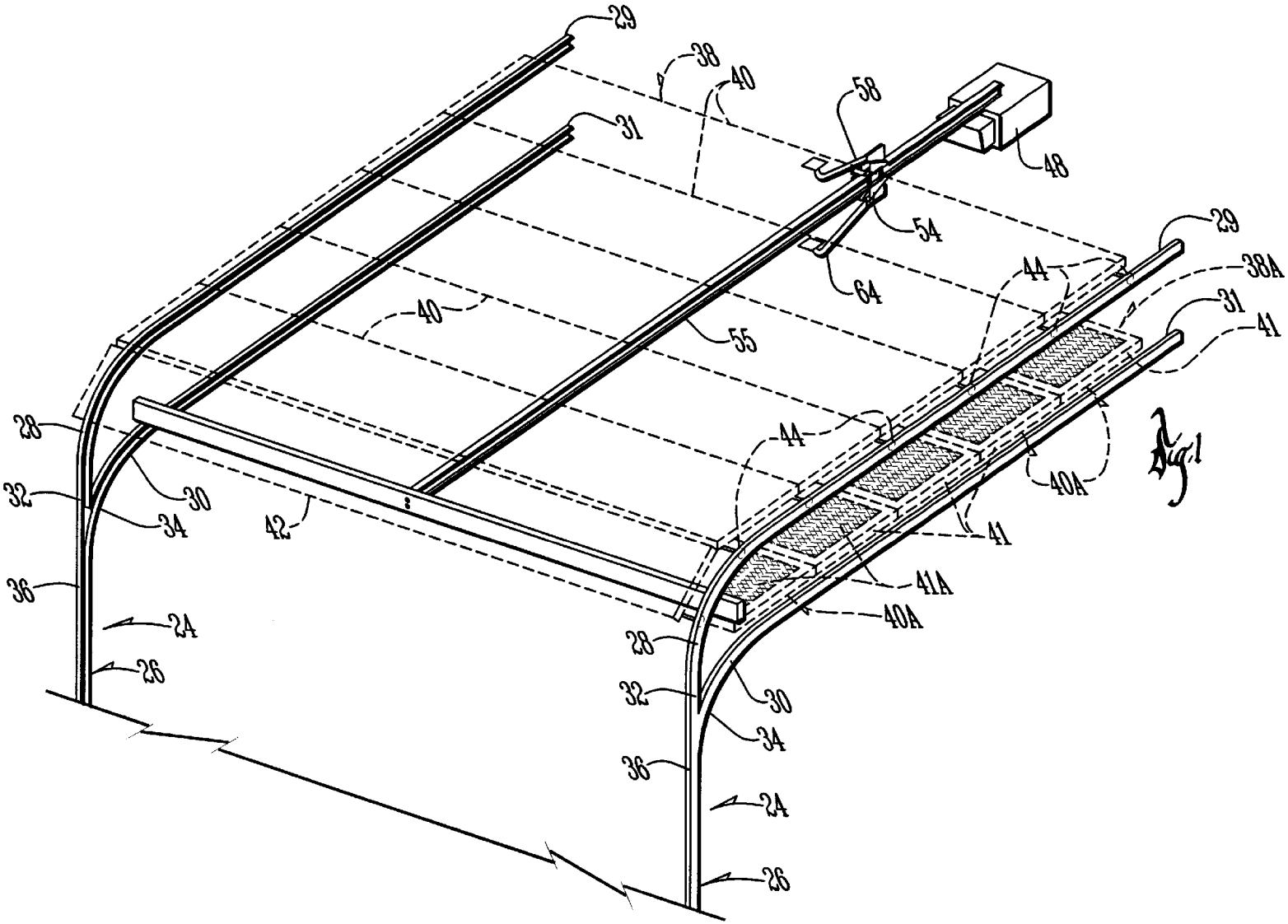
FIG. 1 is a partial schematic view of the device of this invention.

A second foldable door 38A is similar to door 38 except that door 38A is comprised of a plurality of panels 40A similar to the panels 40 in door 38 except that the panels 40A are surrounded by rectangular frames 41 which support conventional screen material 41A (FIG. 1). The panels 40A are horizontally hinged together in the same manner as the panels 40 of door 38. The door 38A also has conventional rollers 44 on its side edges to serve the same purpose as the rollers 44 on door 38. The door 38 is movable in horizontal track portions 31 to the vertical track portions 26 by moving through the curved track segments 30.

Figure 4:
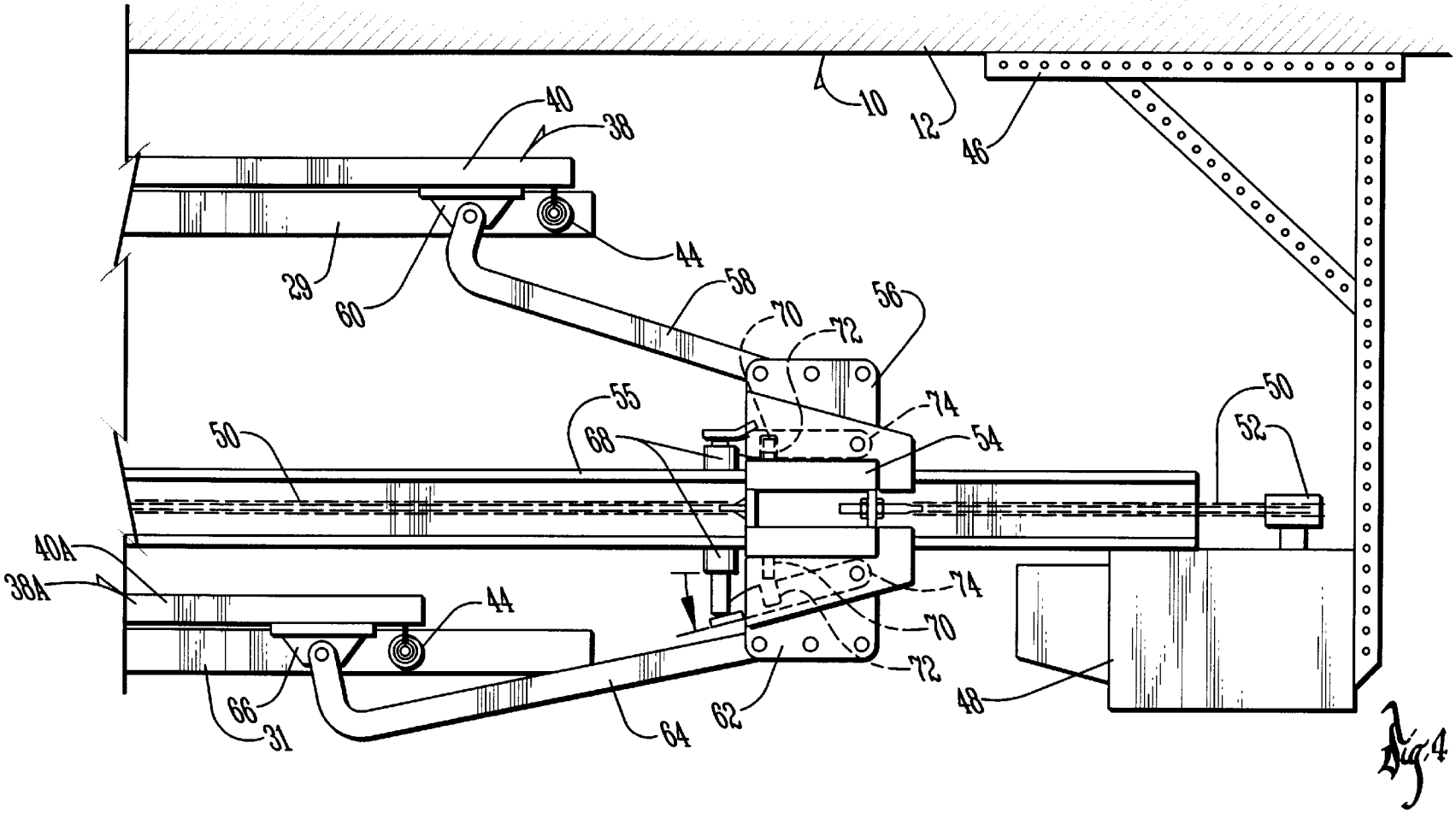
FIG. 4 is a partial side elevation of the drive system for both the solid and screen doors when both of the doors are in an open position.

With reference to FIG. 4, a frame 46 is conventionally supported by ceiling 12 and extends downwardly therefrom. An electric drive means 48 is secured to the lower portion of frame 46 in a convenient manner and serves to selectively move drive chain 50 through the power output shaft and gear assembly 52. A carriage 54 is slidably mounted on elongated track 55. A door latch 56 is secured to carriage 54 in any convenient manner. As best shown in FIG. 4, an arm 58 depends from carriage 54 and is secured to bracket 60 which slides on horizontal track portion 29.

Similarly, a bottom door latch 62 is also secured to carriage 54. An arm 64 depends therefrom and is connected to bracket 66 which slides on horizontal track portion 31. Solenoids 68 are mounted on carriage 54 and are adapted to selectively engage and disengage latch pins 70 on the carriage from the notches 72 on pivotal arm 74 which are secured to each of the arms 58 and 64. Thus, with reference to FIG. 4, when a solenoid 68 is energized to disengage pivotal arm 74 from the latch pin 70 on carrier 54, the movement of the chain 50 by motor 48 will not cause any longitudinal displacement of the second door 38A which is secured to bracket 66. By contrast, the solenoid 68 on the upper portion of carriage 54 shows the pivotal arm 74 in engagement with the pin 70, wherein the movement of the carriage 54 will move arm 58 and cause the corresponding movement of door 38 as the carriage is moved by chain 50.

The controls for the two solenoids 68 have not been shown but are selectively operable from switches located conveniently within the structure 10 to permit the motor 48 to be selectively actuated and to permit the solenoids 68 to also be selectively actuated to move one door or the other. These connections are well within the skill of one having knowledge of the electrical arts and the installation of overhead doors in general.

In operation, only one of the doors 38 and 38A can occupy the vertical track segments 26. Accordingly, when both of the doors are in the open condition as shown in FIG. 3, the drive mechanism 48 is actuated by the operator along with the appropriate solenoid 68 to move either the solid door 38 to a downwardly position as shown in FIG. 2, or to leave the solid door 38 in its open condition as shown in FIG. 3 with the screen door 38A in a lowered position as shown in that same figure.

It is therefore seen that the foregoing structure permits the operator to easily select the door needed for the occasion wherein either the solid door 38 or the screen door 38A can close the opening 16. The two doors can exist in an installed condition throughout the year. Once installed, there will be no removal of either door throughout their respective useful lives. It is therefore seen that this invention will achieve at least all of its stated objectives.

What is claimed is:

1. A dual closure system for overhead doors in a structure having a floor, a vertical wall, a ceiling structure, and a rectangular door opening in the wall extending from the floor upwardly in a direction towards the ceiling structure, comprising, a pair of spaced tracks having a vertical segment extending upward from the floor adjacent vertical sides of the door opening, and terminating through curved track segments into a pair of vertically spaced horizontal upper and lower track portions, the curved track segments both having lower ends arcuately merging into alignment with an upper end of the vertical segments of tracks, and upper ends terminating in the vertically spaced horizontal track portions, first and second foldable doors having sets of rollers in their side edges movably mounted one each in the horizontal portions of the track so each door can be individually moved into a vertical position in the vertical segment of the tracks, and a drive means extending horizontally and spaced between horizontal planes of the spaced horizontal upper and lower track portions, the drive means being operatively connected to the first and second doors for selective movement of either door to a vertical position in the vertical segments of the tracks.

2. The system of claim 1 wherein the first foldable door is comprised of a plurality of horizontally disposed hinged solid panels, and the second foldable door is comprised of a plurality of horizontally disposed hinged screen panels.

3. The system of claim 1 wherein the first foldable door is mounted at times in the horizontal upper track portions, and the second flexible door is mounted at times in the horizontal lower track portions, with the length of the first flexible door being greater than the length of the second flexible door.

4. The system of claim 3 wherein the first foldable door has a hinged panel that dwells within the curved track segments while remaining hinged panels thereof are mounted in the horizontal upper track portions.

5. A dual closure system for overhead doors in a structure having a floor, a vertical wall, a ceiling structure, and a rectangular door opening in the wall extending from the floor upwardly in a direction towards the ceiling structure, comprising, a pair of spaced tracks having a vertical segment extending upward from the floor adjacent vertical sides of the door opening, and terminating through curved track segments into a pair of vertically spaced horizontal upper and lower track portions, the curved track segments both having lower ends arcuately merging into alignment with an upper end of the vertical segments of tracks, and upper ends terminating in the vertically spaced horizontal track portions, first and second foldable doors having sets of rollers in their side edges movably mounted one each in the horizontal portions of the track so each door can be individually moved into a vertical position in the vertical segment of the tracks, a drive track extending horizontally and spaced between horizontal planes of the spaced horizontal upper and lower track portions, the drive track being operatively connected to the first and second doors for selective movement of either door to a vertical position in the vertical segments of the tracks, and a power means connected to the drive track for selectively activating the drive track.

6. The system of claim 5 wherein the first foldable door is comprised of a plurality of horizontally disposed hinged solid panels, and the second foldable door is comprised of a plurality of horizontally disposed hinged screen panels.

7. The system of claim 5 wherein the first foldable door is mounted at times in the horizontal upper track portions, and the second flexible door is mounted at times in the horizontal lower track portions, with the length of the first flexible door being greater than the length of the second flexible door.

8. The system of claim 7 wherein the first foldable door has a hinged panel that dwells within the curved track segments while remaining hinged panels thereof are mounted in the horizontal upper track portions.

9. A dual closure system for overhead doors in a structure having a floor, a vertical wall, a ceiling structure, and a rectangular door opening in the wall extending from the floor upwardly in a direction towards the ceiling structure, comprising, a pair of spaced tracks having a vertical segment extending upward from the floor adjacent vertical sides of the door opening, and terminating through curved track segments into a pair of vertically spaced horizontal upper and lower track portions, the curved track segments both having lower ends arcuately merging into alignment with an upper end of the vertical segments of tracks, and upper ends terminating in the vertically spaced horizontal track portions, first and second foldable doors having sets of rollers in their side edges movably mounted one each in the horizontal portions of the track so each door can be individually moved into a vertical position in the vertical segment of the tracks, a drive track extending horizontally and spaced between horizontal planes of the spaced horizontal upper and lower track portions, the drive track being operatively connected to the first and second doors for selective movement of either door to a vertical position in the vertical segments of the tracks, a power means connected to the drive track for selectively activating the drive track, and a latch means connected to the first and second doors for selective disengagement from the drive track to prevent movement of either door when the drive track is selectively activated.

10. The system of claim 9 wherein the first foldable door is comprised of a plurality of horizontally disposed hinged solid panels, and the second foldable door is comprised of a plurality of horizontally disposed hinged screen panels.

11. The system of claim 9 wherein the first foldable door is mounted at times in the horizontal upper track portions, and the second flexible door is mounted at times in the horizontal lower track portions, with the length of the first flexible door being greater than the length of the second flexible door.

12. The system of claim 11 wherein the first foldable door has a hinged panel that dwells within the curved track segments while remaining hinged panels thereof are mounted in the horizontal upper track portions.

* * * * *